US005389122A

United States Patent [19]

Glicksman

[11] Patent Number: 5,389,122

[45] Date of Patent: Feb. 14, 1995

[54] PROCESS FOR MAKING FINELY DIVIDED, DENSE PACKING, SPHERICAL SHAPED SILVER PARTICLES

[75] Inventor: Howard D. Glicksman, Wilmington, Del.

[73] Assignee: E. I. Du Pont de Nemours and Company, Wilmington, Del.

[21] Appl. No.: 186,244

[22] Filed: Jan. 25, 1994

Related U.S. Application Data

[63] Continuation-in-part of Ser. No. 89,031, Jul. 13, 1993, abandoned.

[51] Int. Cl.[6] ..... B22F 9/24

[52] U.S. Cl. ..... 75/370; 75/371; 75/721; 75/741

[58] Field of Search ..... 75/370, 371, 634, 636, 75/721, 741

[56] References Cited

U.S. PATENT DOCUMENTS

| | | | |
|---|---|---|---|
| 3,885,955 | 5/1975 | Lutz et al. | 75/370 |
| 4,078,918 | 3/1978 | Perman | 75/713 |
| 4,319,920 | 3/1982 | Ehrreich | 75/370 |
| 4,776,883 | 10/1988 | Hayashi et al. | 75/370 |
| 4,863,510 | 9/1989 | Tamemassa et al. | 75/370 |
| 5,292,359 | 3/1994 | Jeng-Shyong et al. | 75/370 |

FOREIGN PATENT DOCUMENTS

| | | | |
|---|---|---|---|
| 0073108 | 3/1983 | European Pat. Off. . | |
| 4-323310 | 11/1992 | Japan | 75/371 |

OTHER PUBLICATIONS

Rev. Roum. Chim. 24, No. 3:411–21 (1979), Ascorbic Acid as a Reducing Agent, VI[1] Kinetics of the Ag(I) Ions Reduction by Ascorbic Acid.

*Primary Examiner*—George Wyszomierski

[57] ABSTRACT

A method for the preparation of finely divided, dense packing, spherical shaped silver particles comprising the sequential steps of:

(1) reacting an aqueous mixture of a silver salt with an alkanolamine to form a homogeneous aqueous solution of a dissolved silver alkanolamine complex;

(2) preparing an aqueous solution of a reducing agent and, optionally, an alkanolamine; and (3) mixing together the silver alkanolamine complex solution and the reducing agent alkanolamine solution at a buffered pH and a temperature of 10° C. to 100° C. to form finely divided spherical silver particles.

12 Claims, No Drawings

PROCESS FOR MAKING FINELY DIVIDED, DENSE PACKING, SPHERICAL SHAPED SILVER PARTICLES

CROSS REFERENCE TO RELATED APPLICATION

This application is a continuation-in-part of U.S. patent application Ser. No. 08/089,031, filed Jul. 13, 1993, now abandoned.

FIELD OF THE INVENTION

The invention is directed to an improved process for making finely divided silver particles. In particular, the invention is directed to a process for making silver powders that are finely divided, dense packing spheres.

BACKGROUND OF THE INVENTION

Silver powder is used in the electronics industry for the manufacture of conductor thick film pastes. The thick film pastes are screen printed onto substrates forming conductive circuit patterns. These circuits are then dried and fired to volatilize the liquid organic vehicle and sinter the silver particles.

Printed circuit technology is requiring denser and more precise electronic circuits. To meet these requirements, the conductive lines have become more narrow in width with smaller distances between lines. The silver powders necessary to form dense, closely packed, narrow lines must be as close as possible to monosized, dense packing spheres.

Many methods currently used to manufacture metal powders can be applied to the production of silver powders. For example, thermal decomposition processes, electrochemical processes, physical processes such as atomization or milling, and chemical reduction methods can be used. Thermal decomposition processes tend to produce powders that are spongy, agglomerated, and very porous whereas electrochemical processes produce powders that are crystalline in shape and very large. Physical processes are generally used to make flaked materials or very large spherical particles. Chemical precipitation processes produce silver powders with a range of sizes and shapes.

Silver powders used in electronic applications are generally manufactured using chemical precipitation processes. Silver powder is produced by chemical reduction in which an aqueous solution of a soluble salt of silver is reacted with an appropriate reducing agent under conditions such that ionic silver is reduced and silver powder is precipitated. Inorganic reducing agents including hydrazine, sulfite salts and formate salts produce powders which are very coarse in size, are irregularly shaped and have a large particle size distribution due to aggregation.

Organic reducing agents such as alcohols, sugars or aldehydes are used to reduce silver nitrate in the presence of a base such as alkali hydroxides or carbonates. See *Silver—Economics, Metallurgy and Use,* A. Butts, ed. 1975, Krieger Publishing Co., N.Y., p. 441. The reduction reaction is very fast, hard to control and produces a powder contaminated with residual alkali ions. Although small in size (e.g., <1 micron), these powders tend to have an irregular shape with a wide distribution of particle sizes that do not pack well. These types of silver powders exhibit difficult to control sintering and inadequate line resolution in thick film conductor circuits.

PRIOR ART

U.S. Pat. No. 4,078,918 1978 Perman

A recovery process for reclaiming precious metals from industrial process residues, such as silver chloride resulting from salt analysis of meats in a packing plant, or alternative, from industrial waste photographic papers or the like. The process comprises pretreating the material with an oxidizing agent capable of substantially completely oxidizing organic contaminants, reacting the material with ammonium hydroxide to form a soluble ammonia complex, and reacting the ammonia complex with ascorbic acid or a salt form of ascorbic acid to provide precious metal in elemental form. The preferred process is for reclaiming silver.

European Patent Application 0 073 108 1981 Perrin

A process for the recovery of metals from solutions containing them, particularly for recovering gold, silver, platinum or other precious metals in a pure from, comprises the use of a reduction reaction using as reducing agent a polyhydroxyl compound. Suitable polyhydroxyl compounds are sugars, particularly those having a lactone structure, for example L-ascorbic, D-isoascorbic acid and salts thereof.

U.S. Pat. No. 4,863,510 1989 Tamemasa et al.

Fine particles of a metal such as copper and silver can be obtained by reducing the corresponding metal ammonium complex salt solution with one or more reducing agents selected from the group consisting of L-ascorbic acid, L-ascorbate, D-erythorbic acid and D-erythorbate.

SUMMARY OF THE INVENTION

This invention is directed to a method for the preparation of finely divided, dense packing, spherical shaped silver particles comprising the sequential steps of (1) reacting an aqueous mixture of a silver salt with an alkanolamine to form a homogeneous aqueous solution of a dissolved silver alkanolamine complex;

(2) preparing an aqueous solution of a reducing agent and, optionally an alkanolamine; and (3) mixing together the silver alkanolamine complex solution and the reducing agent solution at a buffered pH and a temperature between 10° C. to 100° to form finely divided, dense packing, spherical silver particles.

DETAILED DESCRIPTION OF THE INVENTION

The process of the invention is a reductive process in which finely divided, dense packing, spherical silver particles are precipitated by adding together an aqueous solution of a silver alkanolamine complex and an aqueous solution containing the mixture of a reducing agent and an alkanolamine. Finely divided is defined as non-agglomerated with a narrow particle size distribution, dense packing is indicated by large tap density, and spherical shape is determined by scanning electron microscopy.

The silver alkanolamine complex aqueous solution is prepared by first adding a water-soluble silver salt to deionized water to form an aqueous silver mixture. Any water-soluble silver salt can be used in the process of the invention such as silver nitrate, silver phosphate, and silver sulfate. Addition of an alkanolamine to the aqueous silver mixture produces an aqueous solution of a silver alkanolamine complex. An advantage of using alkanolamines to form the water soluble silver complexes is that no silver ammonia complexes are formed which could lead to the formation of explosive silver azide compounds.

Enough alkanolamine is added to prepare a completely dissolved complex. Although an excess of the alkanolamine can be used, it is preferred to add a minimum amount for complete dissolution. Alkanolamines such as monoethanolamine, diethanolamine, triethanolamine, monoisopropanolamine, diisopropanolamine, and the like can be used.

The buffered pH of the reaction is determined by the alkanolamine used. Monoethanolamine gives pH 11, diethanolamine pH 10, triethanolamine pH 9, etc. To prepare finely divided, dense packing, spherical silver powder, the reducing agent is matched with the proper alkanolamine to give the preferred pH of the reaction.

Suitable reducing agents for the process of the invention are 1-ascorbic acid, its salts and related compounds such as sodium ascorbate, d-isoascorbic acid, etc. and related compounds having a lactone ring of the ascorbic acid type such as hydroquinone, quinone, and catechol. Reducing agents such as resorcinol, 4-butyrolactone, furfural, manitol, 1,4-cyclohexanediol, and guaicol are not suitable for this invention.

The reducing solution is prepared by first dissolving the reducing agent in deionized water and then adding enough alkanolamine to keep the process pH buffered so that at the end of the reaction process the pH has not changed. The reduction of silver during the reaction produces acid which reacts with the excess alkanolamine to keep the pH constant. It is important to keep the pH constant throughout the reaction because the resulting silver powder properties are dependent on the pH of the reaction.

Spherical, dense silver powder can be made by having no alkanolamine in the reducing solution provided sufficient alkanolamine is added to the silver complex solution to keep the process pH buffered to the pH of the alkanolamine so that at the end the reaction process the pH has not changed.

The order of preparing the silver alkanolamine complex solution and the reducing solution is not important. The silver alkanolamine complex solution may be prepared before, after, or contemporaneously with the reducing solution preparation. Then, the silver alkanolamine complex solution is mixed with the reducing solution to form the finely divided, dense packing, spherical silver particles. To minimize agglomeration and optimize tap density, the solutions are mixed together quickly at a temperature between 10° C. and 100° C., preferably between 10° and 50° C.

The water is then removed from the suspension by filtration or other suitable liquid-solid separation operation and the solids are washed with water until the conductivity of the wash water is 20 micromhos or less. The water is then removed from the silver particles and the particles are dried.

The following examples and discussion are offered to further illustrate but not limit the process of this invention. A summary of the measured properties is presented in Tables 1, 2 and 3. Note that tap density was determined using the method of ASTM-B527, particle size distribution was measured using a Microtrac® machine from Leeds and Northrup, and surface area was measured with a Micromeritics Flowsorb II 2300. Reporting particle size distribution, $d_{90}$ is the value at the 90th percentile point, $d_{50}$ is the value at the 50th percentile point, and $d_{10}$ is the value at the 10th percentile point.

EXAMPLE 1

The silver alkanolamine complex solution was prepared by first dissolving 52.7 g of silver nitrate in 1 liter of deionized water. While stirring, 44 ml of monoethanolamine was then added dropwise to form the soluble silver alkanolamine complex. The reducing solution was prepared by dissolving 27 g of 1-ascorbic acid in 1 liter of deionized water. While stirring, 150 ml of monoethanolamine was then slowly added.

The two solutions were then poured simultaneously into a plastic receiving vessel in less than 5 seconds. After two minutes, the reaction mixture was filtered using a sintered glass filtering flask. The silver particles were then washed with deionized water until a conductivity of the wash water was less than or equal to 20 micromhos and then dried. This powder was very agglomerated with a low tap density of 1.1 g/ml and a $d_{90}$ of 26.9 microns.

EXAMPLE 2

This sample was made following a similar process as described in Example 1 except that 83 ml of diethanolamine was used to form the silver alkanolamine complex and 146 ml of diethanolamine was added to the reducing solution. The resulting spherical silver powder had a high tap density of 2.8 g/ml, a small surface area of 0.58 $m^2/g$ and a very narrow particle size distribution.

EXAMPLE 3

This sample was made following a similar process as described in Example 1 except that 200 ml of triethanolamine was used to form the silver alkanolamine complex and 150 ml of triethanolamine was added to the reducing solution. This powder was highly agglomerated with a larger surface area of 1.20 $m^2/g$ and a $d_{90}$ of 11.5 microns.

EXAMPLE 4

The silver alkanolamine complex solution was prepared by first dissolving 105.4 g of silver nitrate in 1 liter of deionized water. While stirring, 88 ml of monoethanolamine was then added dropwise to form the soluble silver alkanolamine complex. The reducing solution was prepared by dissolving 54 g of hydroquinone in 1 liter of deionized water. While stirring, 300 ml of monoethanolamine was then slowly added.

The two solutions were then poured simultaneously into a plastic receiving vessel in less than 5 seconds. After two minutes, the reaction mixture was filtered using a sintered glass filtering flask. The silver particles were then washed with deionized water until a conductivity of the wash water was less than or equal to 20 micromhos and then dried. This spherical silver powder was larger in size than that of Examples 1–3. The silver powder had a very high tap density of 4.2 g/ml, a very small surface area of 0.54 $m^2/g$ and a narrow particle size distribution.

EXAMPLE 5

This sample was made following a similar process as described in Example 1 except that 83 ml of diethanolamine was used to form the silver alkanolamine complex; and 27 g of hydroquinone and 150 ml of diethanolamine was added to the reducing solution. This silver powder had smaller particles with a rougher surface and less sphericity. The tap density was 3.6 g/ml and the surface area was 1.39 $m^2/g$.

EXAMPLE 6

This sample was made following a similar process as described in Example 1 except that 200 ml of triethanolamine was used to form the silver alkanolamine complex; and 27 g of hydroquinone and 150 ml of triethanolamine was added to the reducing solution. The silver powder was much smaller in size with a tap density of 2.2 g/ml and a very large surface area of 2.29 $m^2/g$.

EXAMPLE 7

The silver alkanolamine complex solution was prepared by first dissolving 105.4 g of silver nitrate in 1 liter of deionized water. While stirring, 88 ml of monoethanolamine was then added dropwise to form the soluble silver alkanolamine complex. The reducing solution was prepared by dissolving 54 g of d-isoascorbic acid in 1 liter of deionized water. While stirring, 300 ml of monoethanolamine was then slowly added.

The reducing solution was then placed into a plastic receiving vessel and the silver alkanolamine complex solution poured into it in less than 5 seconds. After two minutes, the reaction mixture was filtered using a sintered glass filtering flask. The silver particles were then washed with deionized water until a conductivity of the wash water was less than or equal to 20 micromhos and then dried. The spherical silver powder had a high tap density of 2.2 g/ml, a small surface area of 0.68 $m^2/g$, and a narrow particle size distribution. The silver particles were larger than those of Example 2 but smaller in size than those of Example 4.

EXAMPLE 8

The silver alkanolamine complex solution was prepared by first dissolving 210.8 g of silver nitrate in 1 liter of deionized water. While stirring, 420 ml of diethanolamine was then added dropwise to form the soluble silver alkanolamine complex. The reducing solution was prepared by dissolving 108 g of d-isoascorbic acid in 1 liter of deionized water. While stirring, 600 ml of diethanolamine was then slowly added.

The reducing solution was then placed into a plastic receiving vessel and the silver alkanolamine complex solution poured into it in less than 5 seconds. After two minutes, the reaction mixture was filtered using a sintered glass filtering flask. The silver particles were then washed with deionized water until a conductivity of the wash water was less than or equal to 20 micromhos and then dried. The spherical silver powder had a lower tap density of 1.6 g/ml and a larger surface area of 0.82 $m^2/g$.

EXAMPLE 9

This sample was made following a similar process as described in Example 1 except that 27 g of quinone was used as the reducing agent. This silver powder had a tap density of 3.3 g/ml and a large surface area of 2.45 $m^2/g$.

EXAMPLE 10

This sample was made following a similar process as described in Example 1 except that 83 ml of diethanolamine was used to form the silver alkanolamine complex; and 27 g of quinone and 150 ml of diethanolamine was added to the reducing solution. The silver powder had a high tap density of 3.6 g/ml with a narrow particle size distribution. This silver powder had a much larger surface area of 7.92 $m^2/g$ than the powder of Example 2 or Example 4.

EXAMPLE 11

This sample was made following a similar process as described in Example 1 except that 200 ml of triethanolamine was used to form the silver alkanolamine complex; and 27 g of quinone and 150 ml of triethanolamine was added to the reducing solution. The silver powder was much smaller in size with a $d_{50}$ of 0.77 microns.

EXAMPLES 12–17

The silver alkanolamine complex solution was prepared by first dissolving 210.8 g of silver nitrate in 1 liter of deionized water. While stirring, 420 ml of diethanolamine was then added dropwise to form the soluble silver alkanolamine complex. The temperature of the solution was adjusted as indicated in Table 2. The reducing solution was prepared by dissolving 108 g of 1-ascorbic acid in 1 liter of deionized water. While stirring, 600 ml of diethanolamine was then slowly added.

The reducing solution was then placed into a plastic receiving vessel and the temperature of the solution was adjusted as indicated in Table 2. The silver alkanolamine complex solution was then poured into to the reducing solution in less than 5 seconds. After two minutes, the reaction mixture was filtered using a sintered glass filtering flask. The silver particles were then washed with deionized water until a conductivity of the wash water was less than or equal to 20 micromhos and then dried. Lowering the temperature of the reaction to less than 20° C. increases the agglomeration as shown by the increase in the $d_{90}$ to 6.93 microns and the $d_{50}$ to 3.77 microns. Increasing the temperature above 50° C. increases the agglomeration as shown by the increase in the $d_{90}$.

EXAMPLES 18–23

The silver alkanolamine complex solution was prepared by first dissolving 105.4 g of silver nitrate in 1 liter of deionized water. While stirring, 88 ml of monoethanolamine was then added dropwise to form the soluble silver alkanolamine complex. The temperature of the solution was adjusted as indicated in Table 2. The reducing solution was prepared by dissolving 54 g of hydroquinone in 1 liter of deionized water. While stirring, 300 ml of monoethanolamine was then slowly added.

The reducing solution was then placed into a plastic receiving vessel and the temperature of the solution was adjusted as indicated in Table 2. The silver alkanolamine complex solution was then poured into the reducing solution in less than 5 seconds. After two minutes, the reaction mixture was filtered using a sintered glass filtering flask. The silver particles were then washed with deionized water until a conductivity of the wash water was less than or equal to 20 micromhos and then dried. Increasing the temperature above 25° C. increases the agglomeration and the particle size distribution as shown by the increase in the $d_{90}$ and $d_{50}$.

TABLE 1

| Example | Alkanol Amine[a] | Reducing Agent[b] | pH | Tap Density g/ml | Surface Area $m^2/g$ | Part. Size Distribution d90 | d50 | d10 |
|---|---|---|---|---|---|---|---|---|
| 1 | M | Asc | 11 | 1.1 | 0.92 | 26.9 | 1.79 | 1.26 |
| 2 | D | Asc | 10 | 2.8 | 0.58 | 2.15 | 1.06 | 0.51 |
| 3 | T | Asc | 9 | 2.4 | 1.20 | 11.5 | 1.87 | 0.63 |
| 4 | M | Hyq | 11 | 4.2 | 0.54 | 3.86 | 2.09 | 0.76 |
| 5 | D | Hyq | 10 | 3.6 | 1.39 | 2.06 | 0.94 | 0.46 |
| 6 | T | Hyq | 9 | 2.3 | 2.29 | 1.81 | 0.68 | 0.20 |
| 7 | M | Iso | 11 | 2.2 | 0.68 | 3.51 | 1.79 | 0.71 |
| 8 | D | Iso | 10 | 1.6 | 0.82 | 3.27 | 1.63 | 0.66 |
| 9 | M | Quin | 11 | 3.3 | 2.45 | 3.01 | 1.44 | 0.57 |
| 10 | D | Quin | 10 | 3.6 | 7.92 | 2.14 | 1.12 | 0.54 |
| 11 | T | Quin | 9 | 2.8 | 2.26 | 1.52 | 0.77 | 0.42 |

[a]M = monoethanolamine
D = diethanolamine
T = triethanolamine
[b]Asc = 1-ascorbic acid
Hyq = hydroquinone
Iso = d-isoascorbic acid
Quin = quinone

TABLE 2

| Examples | Temp. °C. | Alkanol Amine[a] | Reducing Agent[b] | Surface Area $m^2/g$ | Tap Density g/ml | Part. Size Distribution d90 | d50 | d10 |
|---|---|---|---|---|---|---|---|---|
| 12 | 10 | D | Asc | 0.76 | 0.92 | 6.93 | 3.77 | 1.42 |
| 13 | 23 | D | Asc | 0.86 | 2.04 | 3.13 | 1.43 | 0.60 |
| 14 | 30 | D | Asc | 0.86 | 2.33 | 2.70 | 1.26 | 0.55 |
| 15 | 40 | D | Asc | 1.02 | 1.50 | 2.20 | 1.07 | 0.51 |
| 16 | 60 | D | Asc | 0.46 | 2.05 | 3.15 | 1.46 | 0.59 |
| 17 | 80 | D | Asc | 0.51 | 1.95 | 5.44 | 1.87 | 0.63 |
| 18 | 10 | M | Hyq | 0.59 | 4.35 | 2.99 | 1.74 | 0.87 |
| 19 | 23 | M | Hyq | 0.92 | 4.05 | 2.44 | 1.35 | 0.66 |
| 20 | 30 | M | Hyq | 0.52 | 4.08 | 4.60 | 2.58 | 0.95 |
| 21 | 40 | M | Hyq | 0.37 | 4.15 | 6.10 | 3.30 | 1.24 |
| 22 | 60 | M | Hyq | 0.80 | 4.21 | 4.31 | 2.35 | 0.87 |
| 23 | 80 | M | Hyq | 0.68 | 3.80 | 4.32 | 2.21 | 0.80 |

[a]M = monoethanolamine
D = diethanolamine
[b]Asc = 1-ascorbic acid
Hyq = hydroquinone

EXAMPLE 24

The silver alkanolamine complex solution was prepared by first dissolving 210.8 g of silver nitrate in 1 liter of deionized water. While stirring, 420 ml of diethanolamine was then added dropwise to form the soluble silver alkanolamine complex. The temperature of the solution was adjusted to 23° C. The reducing solution was prepared by dissolving 108 g of 1-ascorbic acid in 1 liter of deionized water. White stirring, 600 ml of diethanolamine was then slowly added.

The reducing solution was placed into a plastic receiving vessel and the temperature of the solution was adjusted to 23° C. The silver alkanolamine complex solution was then added quickly to the reducing solution. After two minutes, the reaction mixture was filtered using a sintered glass filtering flask. The silver particles were then washed with deionized water until a conductivity of the wash water was less than or equal to 20 micromhos and then dried.

EXAMPLE 25

This sample was made following a similar process as described in Example 24, the difference being that the amount of diethanolamine added to the silver solution was 820 ml and no diethanolamine was added to the reducing solution. This silver powder had a lower tap density and was agglomerated by the larger PSD than the spherical powder in Example 24.

EXAMPLE 26

The silver alkanolamine complex solution was prepared by first dissolving 105.4 g of silver nitrate in 1 liter of deionized water. While stirring, 88 ml of monoethanolamine was then added dropwise to form the soluble silver alkanolamine complex. The temperature of the solution was adjusted to 23° C. The reducing solution was prepared by dissolving 54 g of hydroquinone in 1 liter of deionized water. While stirring, 300 ml of monoethanolamine was then slowly added.

The reducing solution was placed into a plastic receiving vessel and the temperature of the solution was adjusted to 23° C. The silver alkanolamine complex solution was then added quickly to the reducing solution. After two minutes, the reaction mixture was filtered using a sintered glass filtering flask. The silver particles were then washed with deionized water until a conductivity of the wash water was less than or equal to 20 micromhos and then dried.

EXAMPLE 27

This sample was made following a similar process as described in Example 26, the difference being that the amount of monoethanolamine added to the silver solution was 388 ml and no monoethanolamine was added to the reducing solution. This silver powder had similar properties to the silver powder of Example 26.

TABLE 3

| Examples | AA[a] | Reducing Agent[b] | Tap Density g/ml | Surface Area $m^2/g$ | Particle Size Distribution $d_{90}$ | $d_{50}$ | $d_{10}$ |
|---|---|---|---|---|---|---|---|
| 24 | D | Asc | 1.94 | 0.66 | 3.24 | 1.61 | 0.68 |
| 25 | D | Asc | 0.70 | 0.86 | 8.63 | 4.25 | 1.40 |
| 26 | M | Hyq | 4.34 | 0.56 | 2.81 | 1.64 | 0.82 |
| 27 | M | Hyq | 4.06 | 1.26 | 2.98 | 1.73 | 0.83 |

[a]AA = alkanolamine
D = diethanolamine
M = monethanolamine
[b]Asc = 1-ascorbic acid
Hyq = hydroquinone

I claim:

1. A method for the preparation of finely divided, dense packing, spherical shaped silver particles comprising the steps of:

(1) reacting an aqueous mixture of a silver salt with an alkanolamine to form a homogeneous aqueous solution of a dissolved silver alkanolamine complex;

(2) preparing an aqueous solution of a reducing agent and an alkanolamine; and (3) mixing together the silver alkanolamine complex solution and the reducing agent alkanolamine solution at a pH buffered to the pH of the alkanolamine and a temperature of 10° C. to 100° C. to form finely divided spherical silver particles.

2. The method of claim 1 further comprising the steps of:

(4) separating the silver particles from the aqueous solution of step (3);

(5) washing the silver particles with deionized water; and (6) drying the silver particles.

3. The method of claim 2 in which the silver particles are washed until the conductivity of the wash liquid is less than 20 micromhos.

4. The method of claim 1 in which the silver salt is silver nitrate.

5. The method of claim 1 in which the alkanolamine in step (1) and step (2) is selected from the group consisting of monoethanolamine, diethanolamine, triethanolamine, monoisopropanolamine, and diisopropanolamine.

6. The method of claim 1 in which the reducing agent is selected from the group consisting of 1-ascorbic acid, d-isoascorbic acid, hydroquinone, quinone, and catechol.

7. The method of claim 1 in which the temperature is 10°–50° C.

8. The method of claim 1 in which the alkanolamine in step (1) and step (2) is diethanolamine, the reducing agent is 1-ascorbic acid, and the temperature is 20° C.–50° C.

9. The method of claim 1 in which the alkanolamine in step (1) and step (2) is monoethanolamine, the reducing agent is hydroquinone, and the temperature is 10° C.–25° C.

10. The method of claim 1 in which the alkanolamine in step (1) and step (2) is monoethanolamine and the reducing agent is d-isoascorbic acid.

11. The method of claim 1 in which step (2) precedes step (1).

12. The method of claim 1 in which steps (1) and (2) are conducted contemporaneously.

* * * * *